US006622503B1

(12) United States Patent
Bennett et al.

(10) Patent No.: US 6,622,503 B1
(45) Date of Patent: Sep. 23, 2003

(54) EVAPORATOR FAN CONTROL SYSTEM FOR A MULTI-COMPARTMENT REFRIGERATOR

(75) Inventors: William B. Bennett, Allegan, MI (US); James T. Reier, Holland, MI (US)

(73) Assignee: Ranco Inc. of Delaware, Wilmington, DE (US)

( * ) Notice: Subject to any disclaimer, the term of this patent is extended or adjusted under 35 U.S.C. 154(b) by 0 days.

(21) Appl. No.: 10/087,453

(22) Filed: Mar. 1, 2002

(51) Int. Cl.[7] ..... F25D 17/04; F25D 21/06
(52) U.S. Cl. ..... 62/186; 62/187; 62/151
(58) Field of Search ..... 62/186, 187, 151, 62/156, 180, 408

(56) References Cited

U.S. PATENT DOCUMENTS

| | | | | |
|---|---|---|---|---|
| 2,812,642 A | | 11/1957 | Jacobs | |
| 2,997,857 A | | 8/1961 | Clark | |
| 3,005,321 A | | 10/1961 | Devery | |
| 4,151,723 A | * | 5/1979 | Gardner | 62/155 |
| 4,282,720 A | | 8/1981 | Stottmann et al. | |
| 4,459,519 A | * | 7/1984 | Erdman | 318/254 |
| 4,481,785 A | * | 11/1984 | Tershak et al. | 62/153 |
| 4,528,821 A | * | 7/1985 | Tershak et al. | 62/153 |
| 4,688,393 A | | 8/1987 | Linstromberg et al. | |
| 4,689,965 A | * | 9/1987 | Janke et al. | 62/155 |
| 4,732,010 A | | 3/1988 | Linstromberg et al. | |
| 4,741,170 A | | 5/1988 | Tershak | |
| 4,819,442 A | | 4/1989 | Sepso et al. | |
| 4,821,528 A | | 4/1989 | Tershak | |
| 4,903,501 A | | 2/1990 | Harl | |
| 4,920,758 A | | 5/1990 | Janke et al. | |
| 4,924,680 A | | 5/1990 | Janke et al. | |
| 5,201,888 A | | 4/1993 | Beach, Jr. et al. | |
| 5,220,806 A | | 6/1993 | Jaster et al. | |
| 5,255,530 A | | 10/1993 | Janke et al. | |
| 5,355,686 A | | 10/1994 | Weiss | |
| 5,363,667 A | * | 11/1994 | Janke et al. | 62/131 |
| 5,373,705 A | * | 12/1994 | Janke et al. | 62/151 |
| 5,460,009 A | | 10/1995 | Wills et al. | |
| 5,477,699 A | | 12/1995 | Guess et al. | |
| 5,490,394 A | | 2/1996 | Marques et al. | |
| 5,490,395 A | | 2/1996 | Williams et al. | |
| 5,524,447 A | | 6/1996 | Shim | |
| 5,555,736 A | | 9/1996 | Wills et al. | |
| 5,711,159 A | | 1/1998 | Whipple, III | |
| 5,765,382 A | * | 6/1998 | Manning et al. | 62/154 |
| 5,896,749 A | | 4/1999 | Livers, Jr. | |
| 5,992,166 A | | 11/1999 | Tremblay | |
| 5,996,361 A | | 12/1999 | Bessler et al. | |
| 2003/0005713 A1 | * | 1/2003 | Holmes et al. | 62/187 |

FOREIGN PATENT DOCUMENTS

| | | |
|---|---|---|
| EP | 0717247 A1 | 6/1996 |
| EP | 0717248 A1 | 6/1996 |

* cited by examiner

*Primary Examiner*—Chen Wen Jiang
(74) *Attorney, Agent, or Firm*—Leydig, Voit & Mayer, Ltd.

(57) ABSTRACT

An evaporator fan control system is provided for a multi-compartment refrigerator that coordinates operation of the evaporator fan among a cooling cycle for a freezer compartment, a cooling cycle for a fresh food compartment, and an adaptive defrost cycle. An adaptive defrost timer control module is utilized to coordinate operation of the evaporator fan. This control module includes an embedded electronic controller having control logic programmed to operate the evaporator fan whenever either of the thermostats requires cooling, and to lock out operation of the evaporator fan whenever the system is performing a defrost cycle.

13 Claims, 4 Drawing Sheets

EVAPORATOR FAN CONTROL SYSTEM FOR A MULTI-COMPARTMENT REFRIGERATOR

FIELD OF THE INVENTION

The present invention relates generally to temperature control systems for multi-compartment refrigerators, and more particularly to evaporator fan and damper control systems for regulating the temperature of the fresh food and freezer compartments of a refrigerator.

BACKGROUND OF THE INVENTION

In a typical multi-compartment refrigerator there are several methods for controlling the temperature of each of the compartments. It is common practice for the refrigeration system, i.e. the compressor, evaporator, fan, etc., to directly cool the freezer compartment. Air from the freezer compartment is directed to the fresh food compartment by means of an opening from the freezer to the fresh food compartment. Air is throttled in this opening by means of some type of air damper control. The damper has traditionally been a manually operated mechanism, which can be adjusted by the user to vary the freezer temperature. The fresh food temperature is generally controlled by a thermostat which senses the fresh food compartment temperature. The thermostat governs the operation of the compressor and evaporator fan. The resulting freezer temperature is a function of the fresh food compartment set point temperature and the position of the manual damper. It is generally known that this type of control system is not ideal for temperature stability of the freezer, especially when the outside temperature changes and the fresh food set point temperature is changed. The advantage of this system is that it is very inexpensive to produce.

A less traditional means of control used currently in only approximately 15% of standard refrigerators produced in the United States is to cycle the compressor using a thermostat that senses the freezer temperature. The air flow to the fresh food compartment is attenuated by a modulating air damper control. This control uses a refrigerant charged bellows that expands and contracts in response to the temperature of the fresh food compartment. The bellows movement is then used to drive a door, located in the air flow stream, to attenuate air flow to the fresh food compartment. The movement of the door is very predictable, thus allowing this device to be offered on a production basis. This type of control system allows for more accurate temperature control for both compartments than the method described above. Outside temperature variance and door openings are better compensated using this system.

The principal drawback for such a system is cost. Manufacturers positioning certain product as "high performance" are the users of this type of system. The second drawback for such a system is that the fresh food compartment is still slaved to the freezer compartment. The modulating damper can better compensate for changes in set point temperature of the freezer than a manually operated device, but some changes to the temperature of the fresh food compartment are apparent since the fan is only operating when the compressor is operating. The compressor operation is dependent on the thermostat, which is sensing freezer temperature only. Another advantage of the modulating damper is that no external power is required for it to perform. Refrigerator manufacturers are very concerned about power consumption, and are very competitive in reducing power consumption. They are also under tremendous pressure from the Department of Energy to make incremental power consumption reductions.

In response to these pressures and desires to reduce power consumption, manufacturers have sought to solve the problem of temperature variances due to the slaving of the air flow from the freezer to the fresh food compartment. Systems resulting from such endeavors, unlike the prior systems that operated based only on the temperature input from one of the freezer or the fresh food compartment, control the refrigeration components by sensing both the freezer temperature and the fresh food compartment temperature and by using a plurality of single and multi-throw switches to transfer control between the two thermostats. Unfortunately, the use of so many single and multi-throw switches to coordinate the control of the two thermostats, the evaporator fan, and the damper motor greatly increases the cost and complexity of such a system. The required wiring of these switches also increases the labor cost and reduces the overall reliability of such a system.

Such systems, such as that illustrated in FIG. 3, typically utilize a freezer thermostat 101 to control the compressor 103, condenser fan 105, and evaporator fan 107 to regulate the freezer temperature to the set point of the freezer thermostat. A multi-contact fresh food compartment thermostat 109 is then used to control a motorized damper 111 that regulates an opening between the freezer and the fresh food compartment. In addition to the damper, the motor 111 also operates a multi-control-surface cam used to control two multithrow switches 113, 115 that connect and disconnect control of evaporator fan 107 between the two thermostats 101, 109 and energize the motorized damper 111 to open or close.

The state of the switches illustrated in FIG. 3 relates to both compartments being at or below their set point temperatures. If the fresh food compartment thermostat 109 calls for cool (connection between terminal A and B), the motorized damper 111 is energized to open the damper and rotate the cam. When the cam reaches its fully open position, both switches 113 and 115 transition. Switch 113 then allows the fresh food compartment thermostat 109 to control the evaporator fan 107. This increases circulation between the compartments, thereby reducing the amount of time that it takes to achieve the desired temperature. The cam control surface that transitions the evaporator control switch 113 waits until the damper is fully open to allow the fresh food thermostat 109 to energize the fan 107 to reduce the power consumption of running the fan while the damper is in transition. In this state, however, the control of the evaporator fan via the freezer thermostat is disabled as its input through the multi-throw switch 113 is opened.

When the fresh food compartment reaches its desired temperature, the multi-contact fresh food compartment thermostat 109 switches to again close contacts A and C. The motorized damper 111 is energized to drive the damper closed. The control surface on the cam immediately transitions switch 113 to return control of the evaporator fan 107 to the freezer thermostat 101. However, since the control cam does not transition the switch 115 until the damper is fully closed, a power failure that occurs while the damper is in the process of closing but is not yet fully closed can result in a condition where the damper cannot be opened and the evaporator fan 107 cannot be energized. This situation occurs when the power failure lasts long enough for the fresh food compartment to warm above its thermostat set point, thereby closing contact A and B of thermostat 109. Since the switch 115 has not been transitioned by the cam to the state show in FIG. 3 because the damper was not allowed to fully close, no power is provided to the motor 111. As such, the switch 113 stays in the freezer control position illustrated in FIG. 3, which means that the call for cooling from the fresh food compartment cannot be accommodated, and the temperature in this compartment. will likely continue to rise. A service call is then required to reset the cam and the control switches to allow the system to work properly again.

One system that overcomes this failure condition is described in U.S. Pat. No. 5,490,395, entitled AIR BAFFLE FOR A REFRIGERATOR. In the system of this patent, the functionality of the single motorized damper control switch 115 illustrated in FIG. 3 is divided among two single pole, single throw switches 117, 118 as illustrated in the simplified FIG. 4. Unfortunately, the addition of an additional switch also requires a more complex cam that includes an additional cam control surface and an additional cam control surface follower to actuate the additional switch. While overcoming the problem discussed above, the additional cost and complexity of this solution accompanied with the resulting reduction in overall system reliability makes such a system undesirable and cost ineffective.

Therefore, there continues to exist a need in the art for a system that provides better temperature stability of both the freezer compartment and the fresh food compartment of a refrigerator, while reducing the cost and power consumption and increasing the overall reliability of the system.

BRIEF SUMMARY OF THE INVENTION

In light of the above, the present invention provide a new and improved evaporator fan control system for a multi-compartment refrigerator. More specifically, the present invention provides a new and improved evaporator fan control system that enables coordination between the fresh food compartment need for cooling and the freezer compartment need for cooling, while taking into consideration the operational system requirements for energy efficient defrost control.

In a preferred embodiment of the present invention, an evaporator fan control system is presented that is particularly adapted for a multi-compartment refrigerator having a damper controlling an opening between compartments to allow cooling from a first compartment to be transferred to a second compartment. This system comprises a first thermostat positioned to sense temperature in the first compartment, a second thermostat positioned to sense temperature in the second compartment, and an adaptive defrost timer control module that is operably coupled to the first and the second thermostat to determine when each compartment requires cooling. The adaptive defrost timer control module provides an energization output to an evaporator fan. Preferably, the adaptive defrost timer control module energizes the evaporator fan when the second thermostat indicates that the second compartment requires cooling.

Preferably, the adaptive defrost timer control module also energizes the evaporator fan when the first thermostat indicates that the first compartment requires cooling. In one embodiment the adaptive defrost timer control module prevents energization of the evaporator fan when the adaptive defrost timer control enters a defrost cycle, regardless of a status of the first and the second thermostats. In an embodiment where the multi-compartment refrigerator includes a damper that controls a flow of air between the first and the second compartments and that opens when the second thermostat indicates that the second compartment requires cooling, the adaptive defrost timer control module further includes a time delay between indication from the second thermostat that the second compartment requires cooling and energization of the evaporator fan. The time delay is of a duration sufficient to allow the damper to open. However, in one embodiment the time delay does not operate when the second thermostat indicates that the second compartment no longer requires cooling, thereby allowing the adaptive defrost timer control to immediately de-energize the evaporator fan.

In an alternate embodiment of the present invention, an evaporator fan control system for a refrigerator having a freezer compartment and a fresh food compartment is presented. The cooling of the fresh food compartment is controlled via a damper regulating an opening between the freezer compartment and the fresh food compartment. The system comprises an adaptive defrost timer control module having an output coupled to the evaporator fan for turning the evaporator fan on and off, and a thermostat positioned to sense a temperature of the fresh food compartment. The thermostat provides an input to the adaptive defrost timer control module indicating when the fresh food compartment requires cooling. Further, the adaptive defrost timer control module turns the evaporator fan on when the thermostat indicates that the fresh food compartment requires cooling.

Preferably, the adaptive defrost timer control module turns the evaporator fan off when in a defrost cycle regardless of an indication from the thermostat that the fresh food compartment requires cooling. In one embodiment, the system further comprises a second thermostat positioned to sense a temperature of the freezer compartment. This second thermostat provides an input to the adaptive defrost timer control module indicating when the freezer compartment requires cooling. The adaptive defrost timer control module turns the evaporator fan on when the second thermostat indicates that the freezer compartment requires cooling. Preferably, the adaptive defrost timer control module turns the evaporator fan off when in the defrost cycle regardless of an indication from the second thermostat that the freezer compartment requires cooling. Further, the adaptive defrost timer control module turns the evaporator fan off when neither the thermostat indicates that the fresh food compartment requires cooling, nor the second thermostat indicates that the freezer compartment requires cooling.

Further, the adaptive defrost timer control module delays turning the evaporator fan on for a period of time after the thermostat indicates that the fresh food compartment requires cooling to allow the damper to open between the freezer and the fresh food compartment. However, the adaptive defrost timer control module does not delay turning the evaporator fan off after the thermostat indicates that the fresh food compartment no longer requires cooling.

In yet a further embodiment of the present invention, an evaporator fan control system for use in a frost free multi-compartment refrigerator is presented. The refrigerator has a freezer compartment that is cooled by a compressor and an evaporator fan, and a fresh food compartment that is cooled by operation of the evaporator fan to blow air from the freezer compartment into the fresh food compartment through a damper controlled opening between the two compartments. Each compartment has installed therein a thermostat. The refrigerator further includes a defrost heater to effectuate frost free operation. The system of this embodiment comprises an adaptive defrost timer control module having control inputs for sensing the thermostat in the fresh food compartment and the thermostat in the freezer compartment, and control outputs for energizing the evaporator fan, the compressor, and the defrost heater in accordance with programmed logic. This programmed logic is contained within the adaptive defrost timer control and includes a logical OR gate having an input indicating that the thermostat installed in the fresh food compartment requires cooling and an input indicating that the thermostat installed in the freezer compartment requires cooling and an output. The logic also includes a logical NAND gate having an input from the output of the logical OR gate and an inverted input indicating that the refrigerator is in a defrost cycle and an output. The adaptive defrost timer control module energizes the evaporator fan upon generation of a logical 1 at the output of the logical NAND gate.

Preferably, the programmed logic includes a time delay on the input of the logical OR gate indicating that the thermostat installed in the fresh food compartment requires cooling. This time delay is of a period sufficient to allow the damper to open. Further, the time delay does not operate when the input of the logical OR gate indicates that the thermostat installed in the fresh food compartment no longer requires cooling.

Other features and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
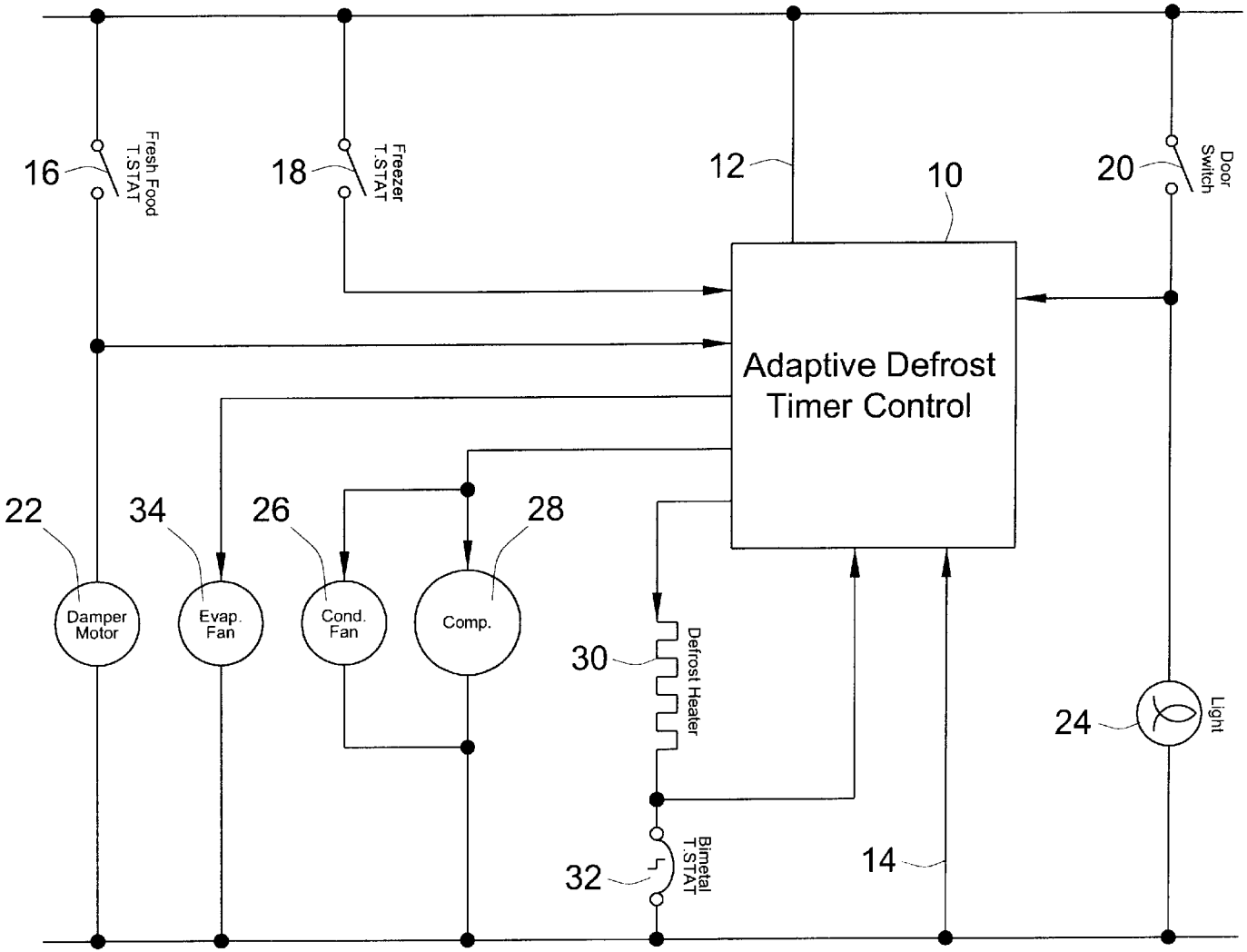
FIG. 1 is a simplified schematic block diagram of a refrigeration control system incorporating the evaporator fan control of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Ever striving for increased energy efficiency, advanced refrigerators typically employ some type of defrost system to ensure that frost build up does not reduce the effectiveness of the cooling cycle. The heart of typical defrost systems is the defrost timer, which opens and closes electrical contacts to control the defrost cycle and the cooling system. When one of these is switched on, the other is switched off. During the cooling mode, the defrost timer closes a contact to the compressor circuit so it will run; the circuit to the defrost heater is open. While in this mode, the freezer thermostat (cold control) cycles the compressor on and off to maintain an appropriate temperature in the freezer compartment. The defrost timer then switches into defrost mode and supplies power to the defrost heaters to melt any frost that has accumulated on the evaporator cooling coil. The cold control contacts may remain closed during the defrost cycle, but since the defrost timer is no longer feeding power to that circuit, the compressor does not run.

Once the defrost thermostat or limit switch senses a set temperature, it opens the circuit to the defrost heaters, shutting them off. The typical defrost timer remains in the defrost cycle until it advances back to the cooling mode. Since the limit switch is open, the heaters are no longer on for the rest of the cycle.

The latest, energy saving variation of the defrost system is computer controlled and called an adaptive defrost control. This adaptive defrost control not only changes the period between defrost cycles change but it also varies the time duration of the defrost cycle itself. The device is programmed to keep track of the appliance usage and how long it takes for the evaporator coil to be thoroughly defrosted. It will then calculate the amount of time required and adjust itself accordingly. The adaptive defrost control uses a microprocessor to continuously monitor refrigeration system performance to determine optimal defrost frequency. Reducing frost that accumulates on the evaporator coil maintains system efficiency and performance. By adapting to changing conditions, and enacting a defrost cycle only when necessary, the control saves the system energy by not using the defrost heater so often.

The underlying theory of the adaptive defrost control concept is that for each unique evaporative refrigeration system there exists an optimum defrost period. If the defrost is accomplished in less than the optimum time, it means that defrost was initiated too soon and if more than the optimum time is required to defrost the evaporator coil it means that frost has accumulated to the point of degrading system performance. Through the use of an adaptive defrost timer control system, the system operates at an optimum level. The increase in system performance and energy savings over prior systems more than justifies the cost of inclusion of the electronic controller.

In the evaporator fan control system of the present invention, the unused computing capacity of the adaptive defrost timer controller is utilized to effectuate the temperature control of the fresh food compartment. However, unlike a mere aggregation of functions, utilization of the adaptive defrost timer control in accordance with the teachings of the present invention provides fully integrated control of the evaporator fan functionality in coordination with the other operating modes of the refrigerator. This coordinated control includes operation of the evaporator fan when the freezer calls for cooling, when the fresh food compartment calls for cooling, or when both call for cooling. Also, the coordination of control with the adaptive defrost timer control allows the evaporator fan to be disabled when in the defrost cycle, regardless of whether the freezer and/or the fresh food compartment call for cooling, functionality heretofore not provided, which further enhances the energy efficiency provided by this integrated control. Further, such integrated control allows for a significant reduction of parts that other systems using an adaptive defrost timer control require.

As illustrated in FIG. 1, the adaptive defrost timer control module 10 is coupled to the refrigerator power 12 and ground 14, and receives the control inputs from the fresh food compartment thermostat 16, the freezer thermostat 18, and the door switch 20. The control of the damper motor 22 to open and close the damper between the freezer and the fresh food compartment may be by any appropriate means that opens the damper when the fresh food compartment calls for cooling and that closes the damper when the fresh food compartment has reached its set point temperature. Similarly, while the adaptive defrost timer control 10 senses the door switch 20 and utilizes this information in its monitoring of system operation and performance, the control of the refrigerator light 24 is directly via the door switch 20.

The control and coordination of the compressor 26 and the condenser fan 28 in the freezer cooling mode and of the defrost heater 30 as regulated by its defrost thermostat 32 in the freezer condenser adaptive defrost cycle are conventional. However, unlike conventional systems that currently use an adaptive defrost timer control, the control and coordination of the evaporator fan 34 is now fully integrated in the adaptive defrost timer control 10 of the present invention.

In prior systems, the adaptive defrost control would operate the evaporator fan with the compressor in a freezer cooling mode, and would not operate the evaporator fan in the defrost mode. However, if the fresh food compartment would require cooling, regardless of what mode in which the adaptive defrost control was operating, the control for the evaporator fan would be switched to the fresh food compartment thermostat via a multi-throw switch as discussed above. This could result in the operation of the evaporator fan during the defrost cycle. Not only is such operation undesirable from a power consumption standpoint, but it greatly affects the defrost cycle by significantly varying the defrost time required. The adaptive defrost control would then completely recalculate the optimum cycle periods for cooling and defrosting, thinking that such variation was the result of non-optimum cycle control. Such recalculation will result in a reduction in system efficiency and increased energy consumption.

If the operation of the evaporator fan during the defrost cycle reduced the amount of time for defrost (as determined by defrost thermostat 32 opening sooner than expected), the adaptive control would lengthen the frost accumulating period. Since the reduction in the defrost time was artificially produced by the fresh food compartment's operation of the evaporator fan, the lengthening of the frost accumulating period may well result in an undue build up of frost on the condenser coils, thereby reducing the cooling efficiency of the system. The converse also adversely affects the energy efficiency of the system. That is, if the defrost cycle time is lengthened by the operation of the evaporator fan, the adaptive defrost control will shorten the frost accumulation period, i.e. run the heater more often. Once again, this greatly reduces the efficiency of the system and increases the power consumption.

To prevent such inefficient recalculations, the adaptive defrost timer control module 10 of the present invention coordinates the control of both the freezer and the fresh food compartment cooling. That is, operation of the evaporator fan 34 is now completely controlled and coordinated by the adaptive defrost timer control module 10 based on the input cooling requirements of the freezer and the fresh food compartments, and based on the adaptive defrost cycle.

The adaptive defrost timer control module 10 is an electronic control assembly based on an embedded microcontroller device. In one embodiment, the output to the compressor 28 and to the defrost heater 30 are energized from a single 1 form C relay under control of the microcontroller. The compressor 28 is connected to the normally closed contact of the relay and the defrost heater 30 is connected to the normally open contact of the relay. The common contact of the relay is tied to the freezer thermostat 18, which cycles power from L1. Alternate wiring methods are available that allow the freezer thermostat 18 to be placed in series with the compressor output. Further, the freezer thermostat 18 may simply be sensed by the microcontroller as a control input. In that configuration the common contact is tied directly to L1. The output to the evaporator fan 34 is energized from a solid state triac that is tied to L1. To this assembly the input from the fresh food thermostat 16 is added and input to the microcontroller device. However, the actual configuration of the adaptive defrost timer control module 10 is not limiting of the invention.

Figure 2:
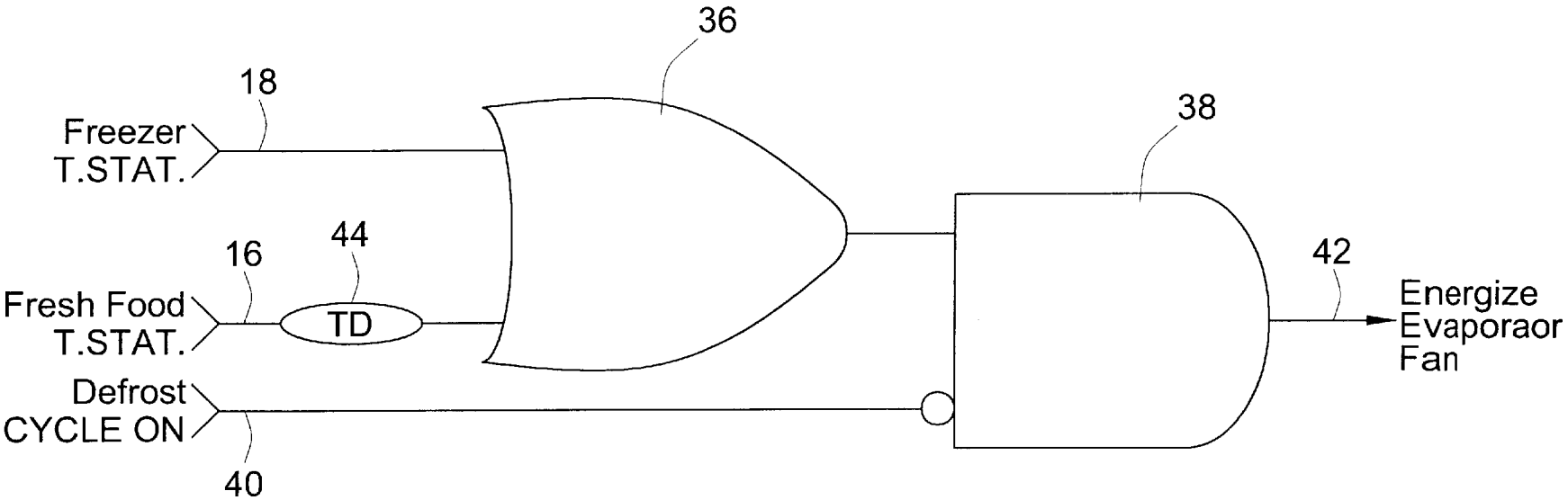
FIG. 2 is a logic diagram illustrating operational control logic constructed in accordance with the present invention.
Figure 3:
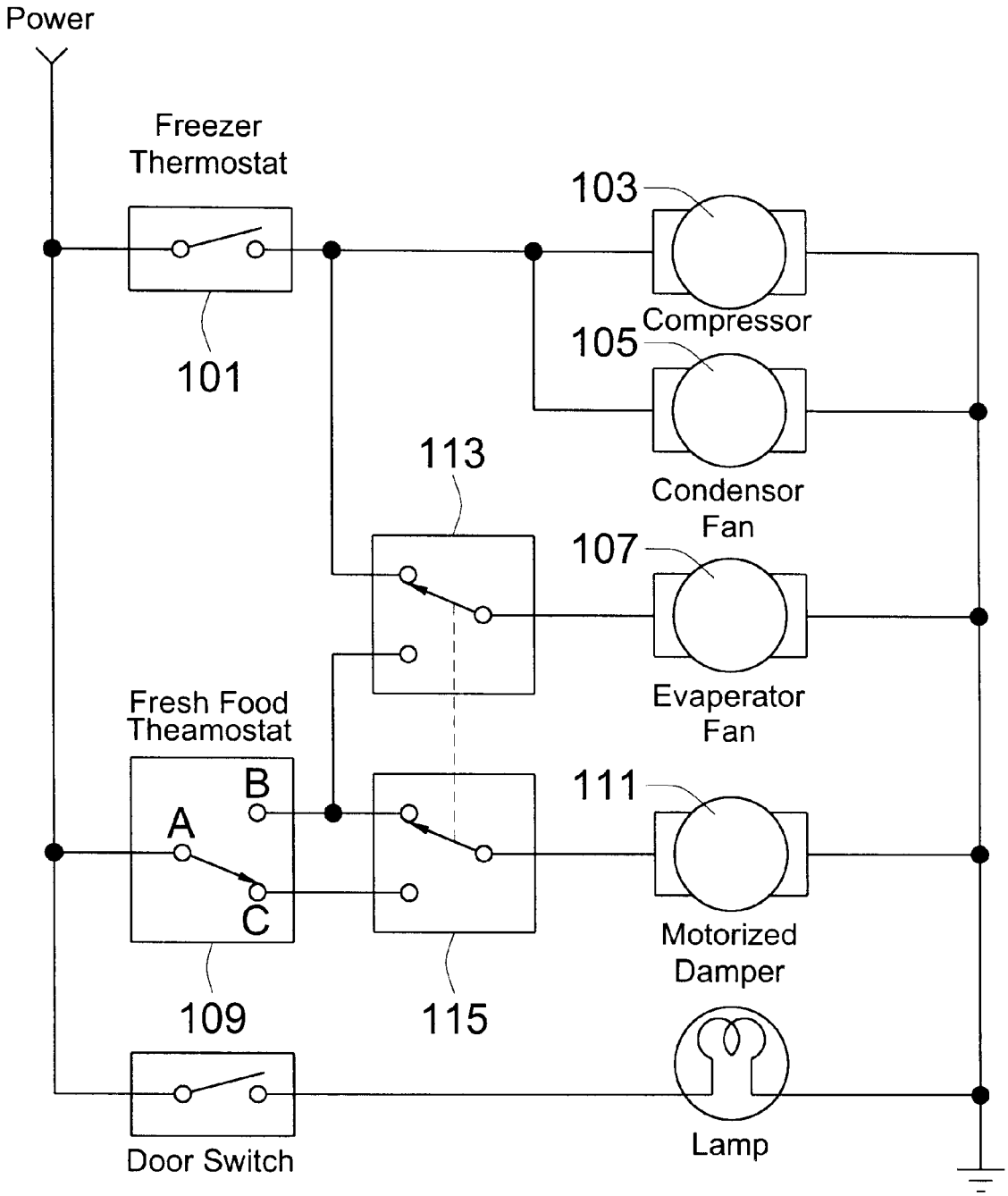
FIG. 3 (PRIOR ART)
FIG. 3 is a simplified schematic block diagram of a prior refrigeration control system utilizing cam controlled switches to effectuate evaporator fan control.
Figure 4:
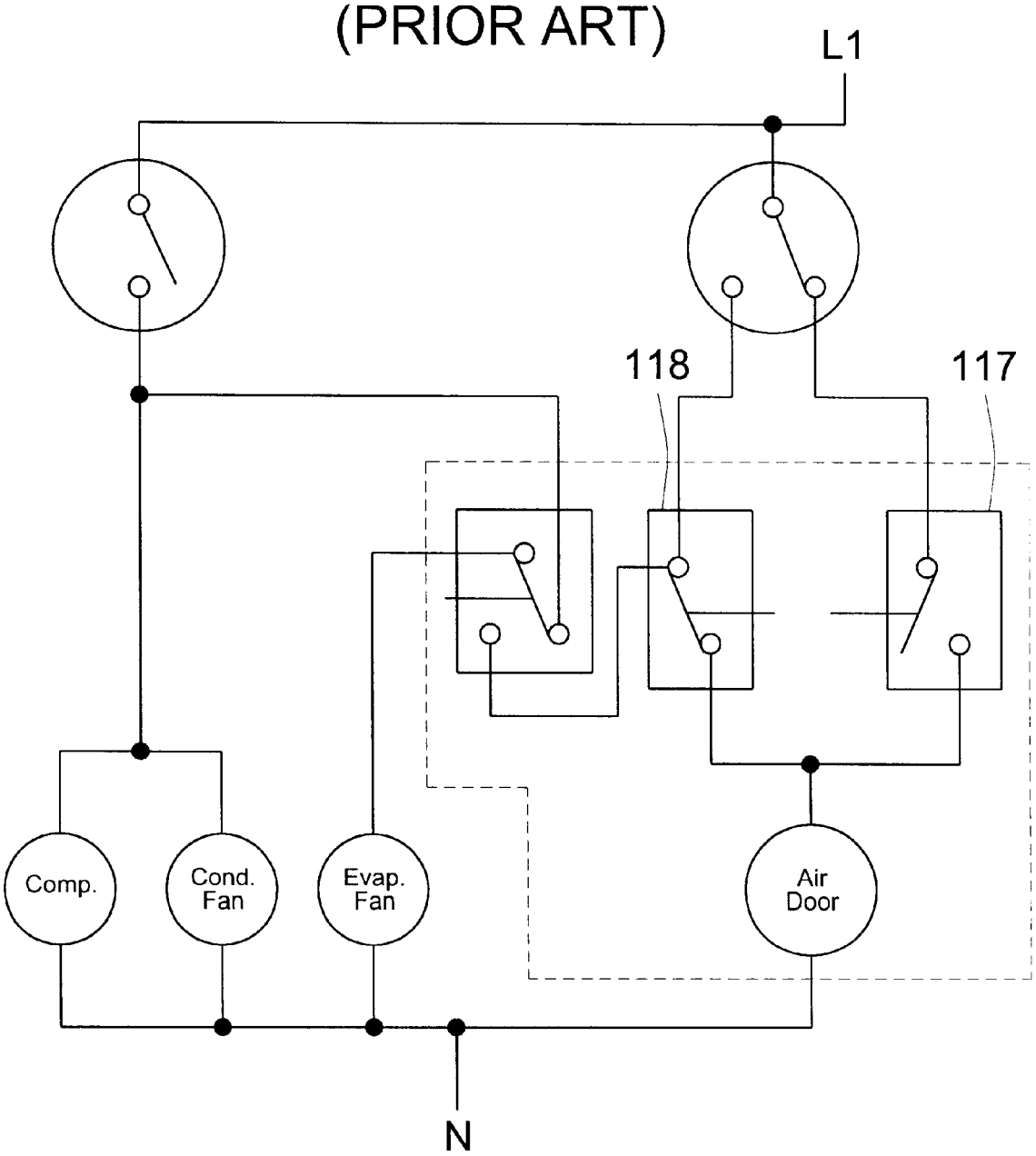
FIG. 4 (PRIOR ART)
FIG. 4 is a simplified schematic block diagram of a second prior refrigeration control system utilizing cam controlled switches to effectuate evaporator fan control.

Within the microcontroller of the adaptive defrost timer control, logic to coordinate the control of the evaporator fan 34 is added. Such control logic is illustrated in FIG. 2. This control logic inputs the freezer thermostat 18 status and the fresh food thermostat 16 status to control the energization of the evaporator fan 34. An optional time delay 44 is illustrated that delays the processing of the signal from the fresh food compartment thermostat 16 a time sufficient to ensure that the baffle or damper between the freezer and the fresh food compartment is open before energizing the evaporator fan 34. This further increases the energy efficiency of the system by not running the evaporator fan until it can actually affect the temperature of the fresh food compartment. This delay preferably does not delay the turn off of the evaporator fan when the thermostat 16 no longer requires cooling. By using a logical OR function 36, the output energization signal 42 will be generated whenever either of these two inputs 16, 18 signal that cooling is required. Further, the output energization signal 42 will be generated when both of these two inputs 16, 18 signal that cooling is required.

The control logic also takes into consideration the defrost cycle on status signal 40 to prevent the generation of the energization signal 42 through a NAND function 38. That is, even if one or both of the thermostats 16, 18 require cooling, if the system is in the defrost cycle as indicated by a logical 1 on line 40, the output 42 is held to a logical 0 thereby preventing operation of the evaporator fan 34. Similarly, if the evaporator fan 34 is energized because, e.g., the fresh food thermostat 16 requires cooling, entrance into the defrost mode, which is calculated independent of the fresh food compartment requirements, will immediately de-energize the evaporator fan. Once the defrost cycle is complete, line 40 goes to a logical 0 and NAND gate 38 will output signal 42 to allow the evaporator fan to be energized if either or both of the thermostats 16, 18 still requires cooling.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An evaporator fan control system for a multi-compartment refrigerator having a damper controlling an opening between compartments to allow cooling from a first compartment to be transferred to a second compartment, comprising:

a first thermostat positioned to sense temperature in the first compartment;

a second thermostat positioned to sense temperature in the second compartment;

an adaptive defrost timer control module operably coupled to the first and the second thermostat to determine when each compartment requires cooling, the adaptive defrost timer control module providing an energization output to an evaporator fan;

wherein the adaptive defrost timer control module energizes the evaporator fan when the second thermostat indicates that the second compartment requires cooling; and wherein the multi-compartment refrigerator includes a damper that controls a flow of air between the first and the second compartments and that opens when the second thermostat indicates that the second compartment requires cooling, wherein the adaptive defrost timer control module further includes a time delay between indication from the second thermostat that the second compartment requires cooling and energization of the evaporator fan of a duration sufficient to allow the damper to open.

2. The system of claim 1, wherein the adaptive defrost timer control module energizes the evaporator fan when the first thermostat indicates that the first compartment requires cooling.

3. The system of claim 2, wherein the adaptive defrost timer control module prevents energization of the evaporator fan when the adaptive defrost timer control enters a defrost cycle regardless of a status of the first and the second thermostats.

4. The system of claim 1, wherein the time delay does not operate when the second thermostat indicates that the second compartment no longer requires cooling, thereby allowing the adaptive defrost timer control to immediately de-energize the evaporator fan.

5. An evaporator fan control system for a refigerator having a freezer compartment and a fresh food compartments, cooling of the fresh food compartment being controlled via a damper regulating an opening between the freezer compartment and the fresh food compartment, comprising:

an adaptive defrost timer control module having an output coupled to the evaporator fan for turning the evaporator fan on and off;

a thermostat positioned to sense a temperature of the fresh food compartment, the thermostat providing an input to the adaptive defrost timer control module indicating when the fresh food compartment requires cooling;

wherein the adaptive defrost timer control module turns the evaporator fan on when the thermostat indicates that the fresh food compartment requires cooling; and wherein the adaptive defrost timer control module delays turning the evaporator fan on for a period of time after the thermostat indicates that the fresh food compartment requires cooling to allow the damper to open between the freezer and the fresh food compartment.

6. The system of claim 5, wherein the adaptive defrost timer control module turns the evaporator fan off when in a defrost cycle regardless of an indication from the thermostat that the fresh food compartment requires cooling.

7. The system of claim 6, further comprising a second thermostat positioned to sense a temperature of the freezer compartment, the second thermostat providing an input to the adaptive defrost timer control module indicating when the freezer compartment requires cooling, and wherein the adaptive defrost timer control module turns the evaporator fan on when the second thermostat indicates that the freezer compartment requires cooling.

8. The system of claim 7, wherein the adaptive defrost timer control module turns the evaporator fan off when in the defrost cycle regardless of an indication from the second thermostat that the freezer compartment requires cooling.

9. The system of claim 8, wherein the adaptive defrost timer control module turns the evaporator fan off when neither the thermostat indicates that the fresh food compartment requires cooling, nor the second thermostat indicates that the freezer compartment requires cooling.

10. The system of claim 5, wherein the adaptive defrost timer control module does not delay turning the evaporator fan off after the thermostat indicates that the fresh food compartment no longer requires cooling.

11. An evaporator fan control system for use in a frost free multi-compartment refrigerator having a freezer compartment that is cooled by a compressor and an evaporator fan, and a fresh food compartment that is cooled by operation of the evaporator fan to blow air from the freezer compartment into the fresh food compartment through a damper controlled opening between the freezer compartment and the fresh food compartment, each compartment having installed therein a thermostat, the refrigerator further including a defrost heater to effectuate frost free operation, the system comprising an adaptive defrost timer control module having control inputs for sensing the thermostat in the fresh food compartment and the thermostat in the freezer compartment, and control outputs for energizing the evaporator fan, the compressor, and the defrost heater in accordance with programmed logic contained within the adaptive defrost timer control, the programmed logic including a logical OR gate having an input indicating that the thermostat installed in the fresh food compartment requires cooling and an input indicating that the thermostat installed in the freezer compartment requires cooling and an output, and a logical NAND gate having an input from the output of the logical OR gate and an inverted input indicating that the refrigerator is in a defrost cycle and an output, the adaptive defrost timer control module energizing the evaporator fan upon generation of a logical 1 at the output of the logical NAND gate.

12. The system of claim 11, wherein the programmed logic includes a time delay on the input of the logical OR gate indicating that the thermostat installed in the fresh food compartment requires cooling, the time delay being of a period sufficient to allow the damper to open.

13. The system of claim 12, wherein the time delay does not operate when the input of the logical OR gate indicates that the thermostat installed in the fresh food compartment no longer requires cooling.

* * * * *